US010418205B2

(12) United States Patent
Sun

(10) Patent No.: US 10,418,205 B2
(45) Date of Patent: Sep. 17, 2019

(54) SUPPORT FRAME STRUCTURE OF SEE-THROUGH BUTTON

(71) Applicant: Jen-Wen Sun, New Taipei (TW)

(72) Inventor: Jen-Wen Sun, New Taipei (TW)

( * ) Notice: Subject to any disclaimer, the term of this patent is extended or adjusted under 35 U.S.C. 154(b) by 106 days.

(21) Appl. No.: 15/717,954

(22) Filed: Sep. 28, 2017

(65) Prior Publication Data

US 2019/0096601 A1 Mar. 28, 2019

(51) Int. Cl.

| | |
|---|---|
| ***H01H 13/14*** | (2006.01) |
| ***H01H 13/02*** | (2006.01) |
| ***H01H 13/20*** | (2006.01) |
| ***H01H 13/10*** | (2006.01) |
| ***H01H 13/83*** | (2006.01) |

(52) U.S. Cl.

CPC ..... *H01H 13/14* (2013.01); *H01H 13/023* (2013.01); *H01H 13/10* (2013.01); *H01H 13/20* (2013.01); *H01H 13/83* (2013.01); *H01H 2221/07* (2013.01)

(58) Field of Classification Search

CPC ..... H01H 13/14; H01H 13/10; H01H 13/20; H01H 13/83

USPC ..... 200/5 A

See application file for complete search history.

(56) References Cited

U.S. PATENT DOCUMENTS

| | | | | |
|---|---|---|---|---|
| 8,080,751 | B2 * | 12/2011 | Onuki | H01H 13/023 200/314 |
| 2007/0235306 | A1 * | 10/2007 | Chiba | H01H 13/83 200/314 |
| 2013/0026017 | A1 * | 1/2013 | Verd Martinez | H01H 9/161 200/307 |

* cited by examiner

*Primary Examiner* — Edwin A. Leon
*Assistant Examiner* — Iman Malakooti
(74) *Attorney, Agent, or Firm* — Leong C. Lei

(57) ABSTRACT

A button includes a display element including a mounting section, a hollowed bottom board having a joint section, support frame members having an interconnection driving section, a button cap body having a light-transmitting section and a contacting section, and an elastic element. The support frame members and the elastic element are arranged on the contacting section located outside the button cap body to that a user is allowed to see, by way of the light-transmitting section of the button cap body, through the hollowed bottom board to the display element at the bottom so as to completely observe a text/pattern section of the display element. In a pressing-down operation, the interconnection driving section makes the support frame members to operate with leverage for causing the elastic element to drive the display element. Further, individual button modularization can be achieved with the arrangement of the mounting section and the joint section.

10 Claims, 12 Drawing Sheets

SUPPORT FRAME STRUCTURE OF SEE-THROUGH BUTTON

TECHNICAL FIELD OF THE INVENTION

The present invention relates generally to a support frame structure of a see-through button, in which a support frame and an elastic element are arranged at a site corresponding to a sidewall of a button cap so that a display screen arranged on a bottom can be observed from a top side of the button cap by seeing therethrough and multiple buttons are installed individually and separately to feature individual button modularization.

DESCRIPTION OF THE PRIOR ART

To provide a button with a luminous feature, a luminous element is arranged under a button cap, and a surface part of the button cap of the button is made of a light-transmitting material so that light emitting from the underside of the material may transmit through the surface of the button cap to achieve an effect of luminosity of a keyboard. However, contact points inside the keyboard, including rubber pads and scissors-like supports, are arranged exactly under the button so that the light source suffers poor performance of light spreading. In applications where a displaying function is included in the button by simply replacing the luminous element with a displaying screen, an image displayed on the screen would be obstructed by the rubber pad and the scissors-like support arranged exactly under the button cap so that the image cannot be completely displayed and watched.

The fevering of the trend of customization leads to diversification of keyboard configurations, button numbers, and button arrangement. However, the fabrication of a keyboard involves several factors, including membrane circuit, housing hollowed in correspondence to contact points, and button structure, which must be fabricated in a mutually matched manner. Further, in addition to outside appearance finishing that is often carried out in advance, assembling a button also requires, in mounting to a keyboard, a connection structure of a support frame provided on the button cap to connect with a carrier. Such a connection operation applies external forces in multiple directions to the support frame and this readily cause deformation and damage of the structure, making it adverse to designs for customization.

SUMMARY OF THE INVENTION

One of the objectives of the present invention is that support frame members and an elastic element are arranged at a sidewall of a button cap body to prevent obstructing a central portion of a button so as to allow seeing through from a top side of the button cap directly to a screen on the bottom and a hollowed bottom board is provided on one side of the button cap body and is provided with joint sections that are coupled to mounting sections provided at corresponding locations on a display element to thereby reduce the manufacturing cost of a button and to realize individual button modularization.

Another one of the objective of the present invention is that support frame members are arranged to support, through leverage, a vertical movement of a button cap body above the display element so as to simplify an essential structural arrangement for supporting and coupling.

The present invention provides a structure that comprises a display element for displaying at least one text/pattern section. A plurality of mounting sections is provided on at least one side of the display element. At least one hollowed bottom that has a hollowed portion to completely expose the text/pattern section is arranged above the display element. The hollowed bottom board is provided at least one joint section at one side thereof for coupling with the mounting sections. The hollowed bottom board is provided, on an outer side thereof, with a plurality of support frame members. Ends of the support frame members are formed as at least one interconnection driving section that drives the support frame members to synchronously rotate in a manner of mutually driving each other. At least one button cap body is arranged at the side of the support frame members that is opposite to the hollowed bottom board. The button cap body comprises a light-transmitting section located exactly above the hollowed portion of the hollowed bottom board for seeing therethrough to the display element and at least one contacting section formed on outside of the light-transmitting section. At least one elastic element is provided on the hollowed bottom board for selectively contacting the contacting section to drive the display element. In this invention, arranged at a location exactly above the display element are only the hollowed portion of the hollowed bottom board and the light-transmitting section of the button cap body so that a user is allowed to see therethrough to the display element at the bottommost position. The support frame members and the elastic element that are necessary are respectively arranged at the outer side of the hollowed bottom board and on the contacting section at one side of the button cap body to avoid of a viewable range of the display element. The operation of the support frame members is conduct, through interconnection and mutual driving between the interconnection driving section, to allow the support frame members to support, through leverage, a reciprocal vertical movement of the button cap body for contacting the elastic element to trigger the display element to display contents associated with the triggering. Further, since the joint sections of the hollowed bottom board are connectable to the mounting sections provided at one side of the display element, assembling an individual button is simplified and the manufacturing cost and maintenance cost can be reduced through individual button modularization.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
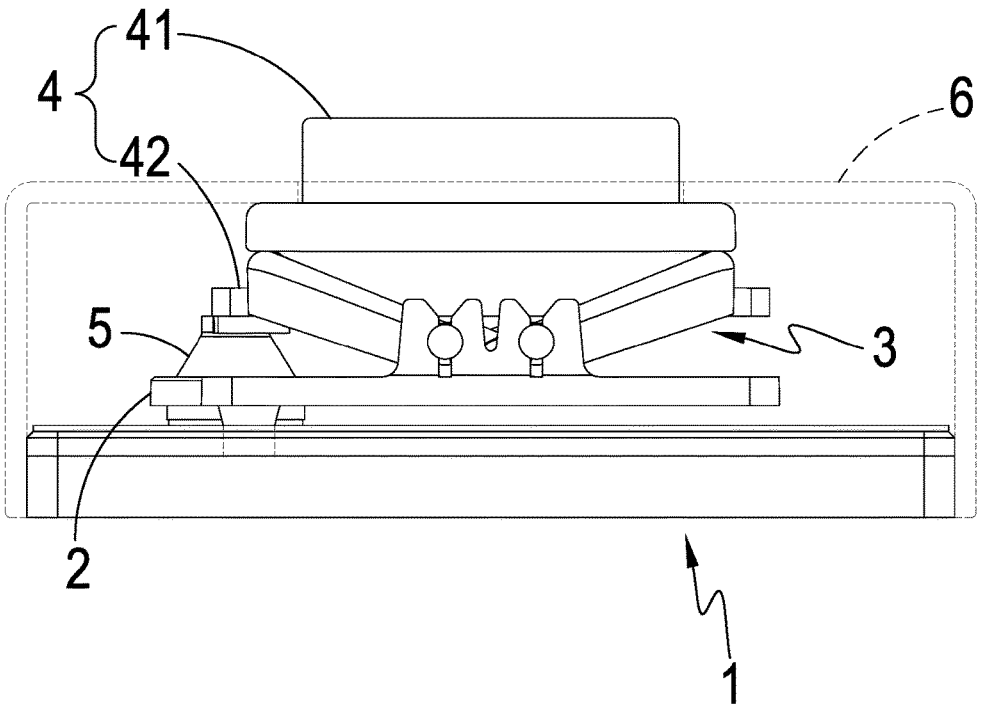
FIG. 1 is a front view of the present invention.
Figure 2:
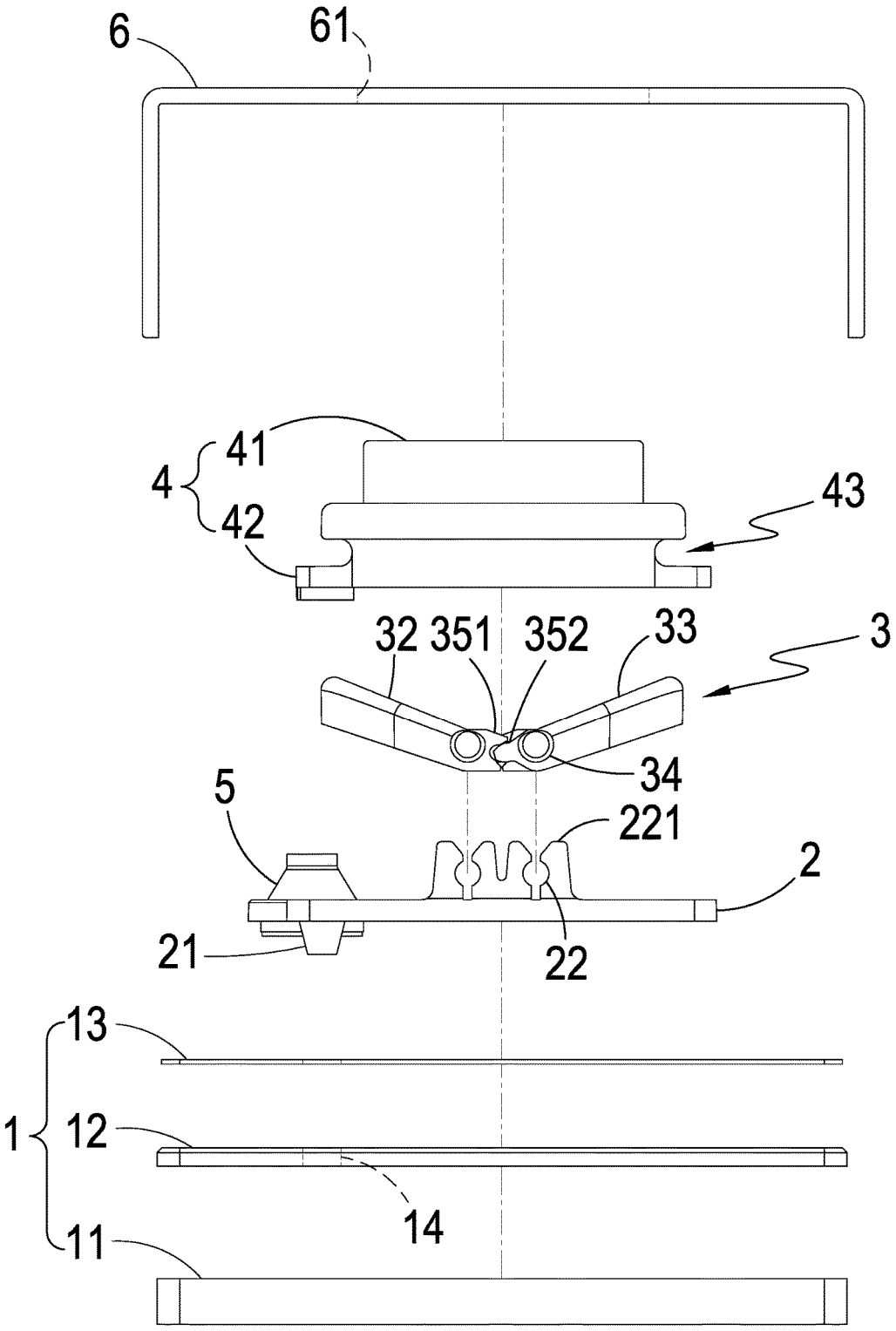
FIG. 2 is an exploded view of the present invention.
Figure 3:
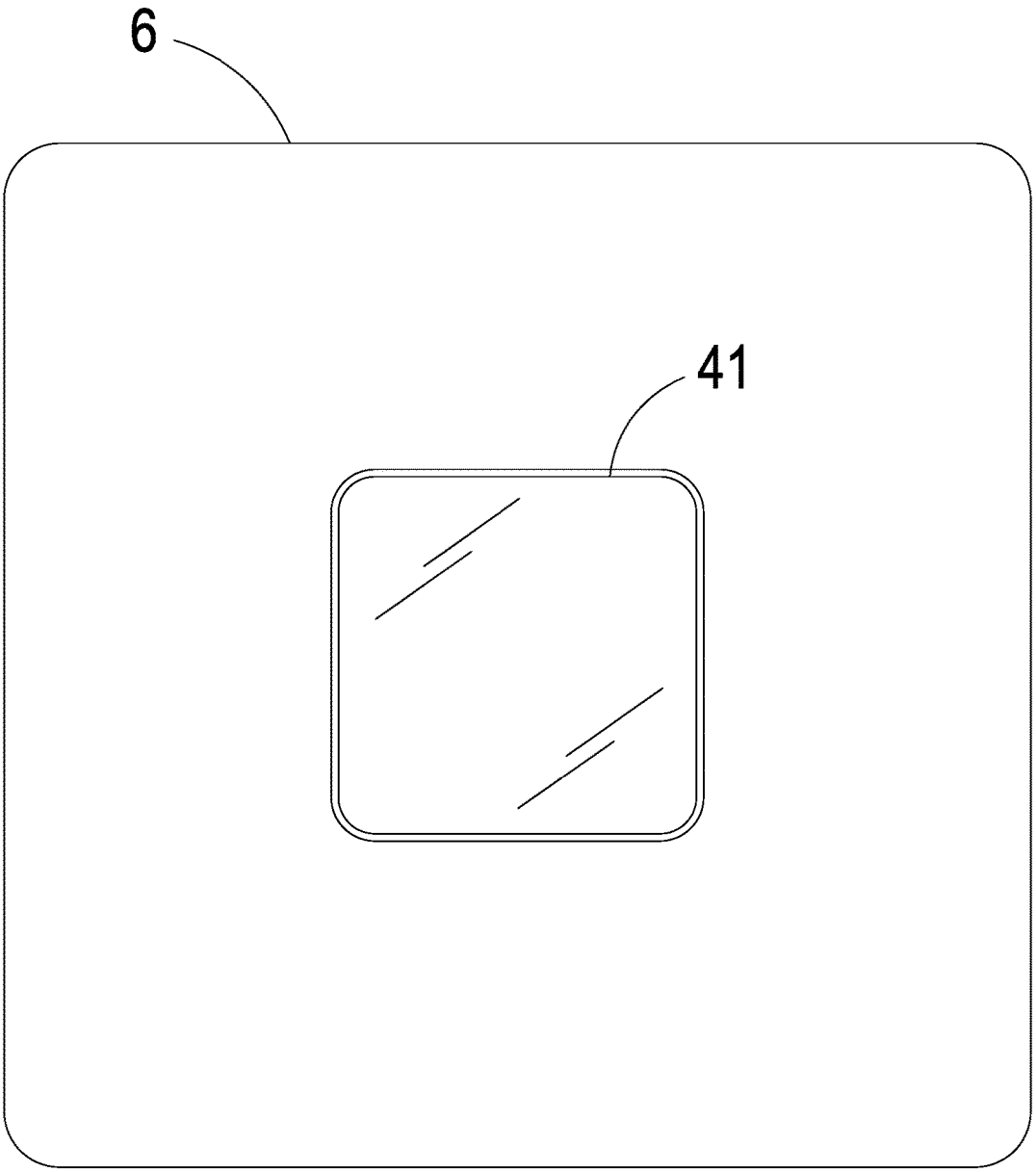
FIG. 3 is a top plan view of the present invention.
Figure 4:
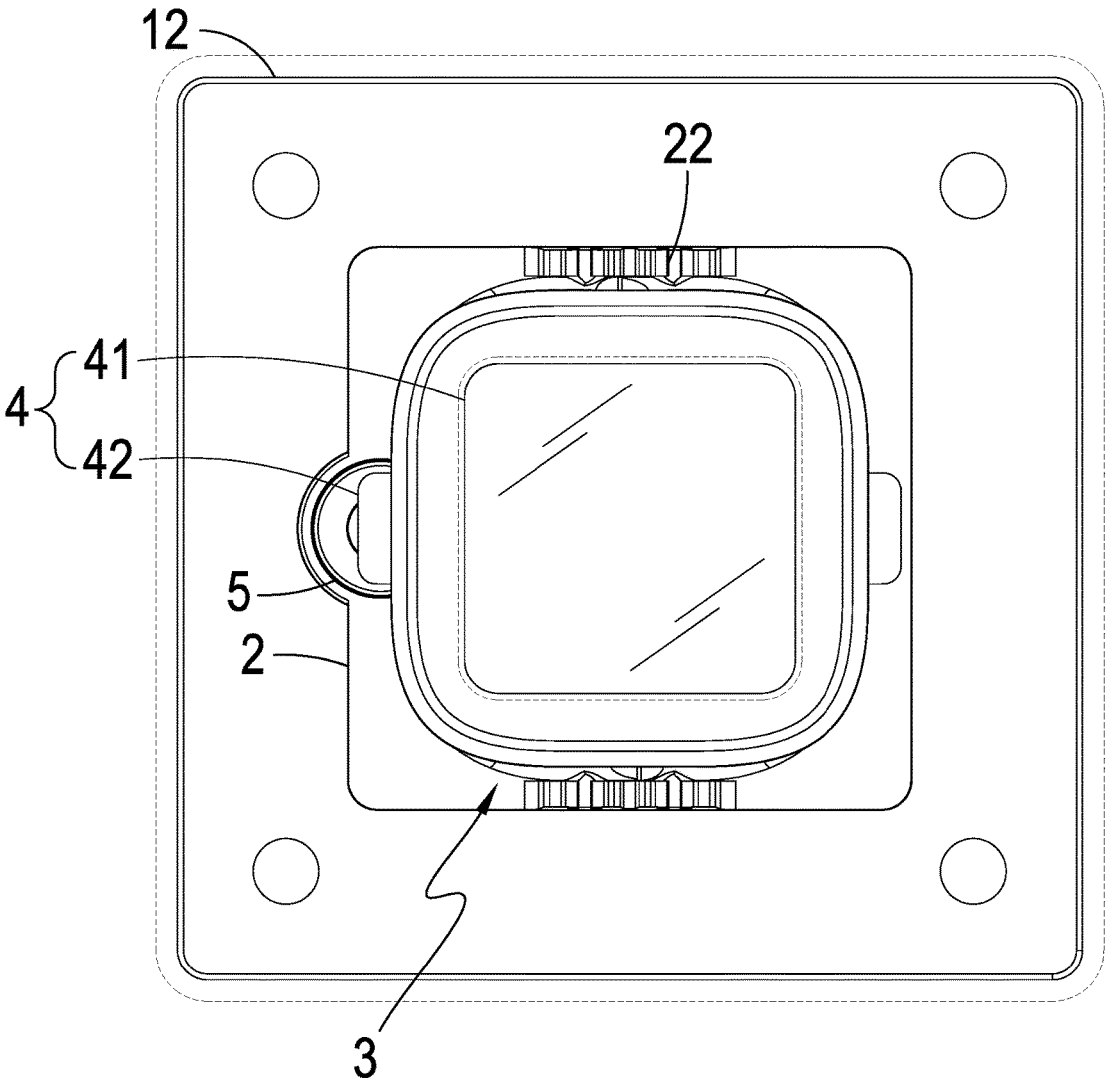
FIG. 4 is a top plan view of the present invention with certain parts removed to show inside details.
Figure 5:
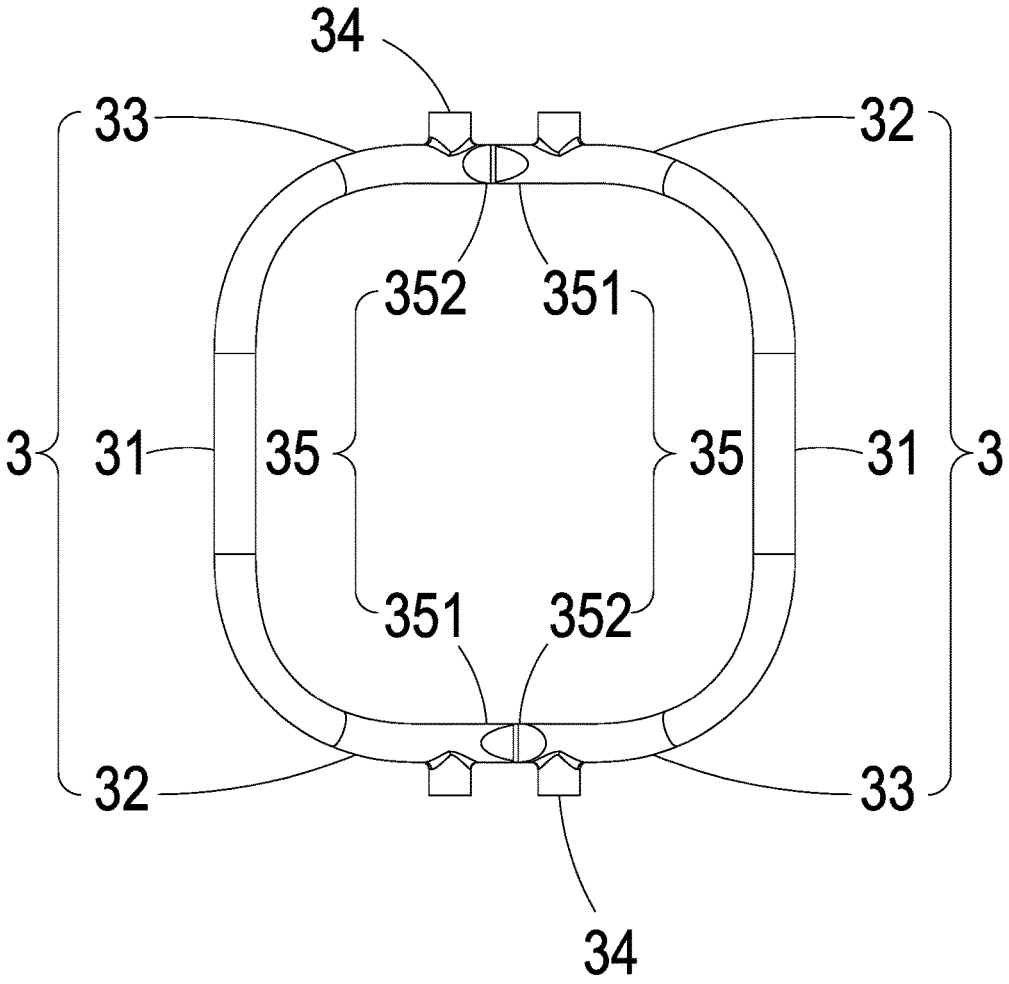
FIG. 5 is a top plan view of support frame members of the present invention.
Figure 6:
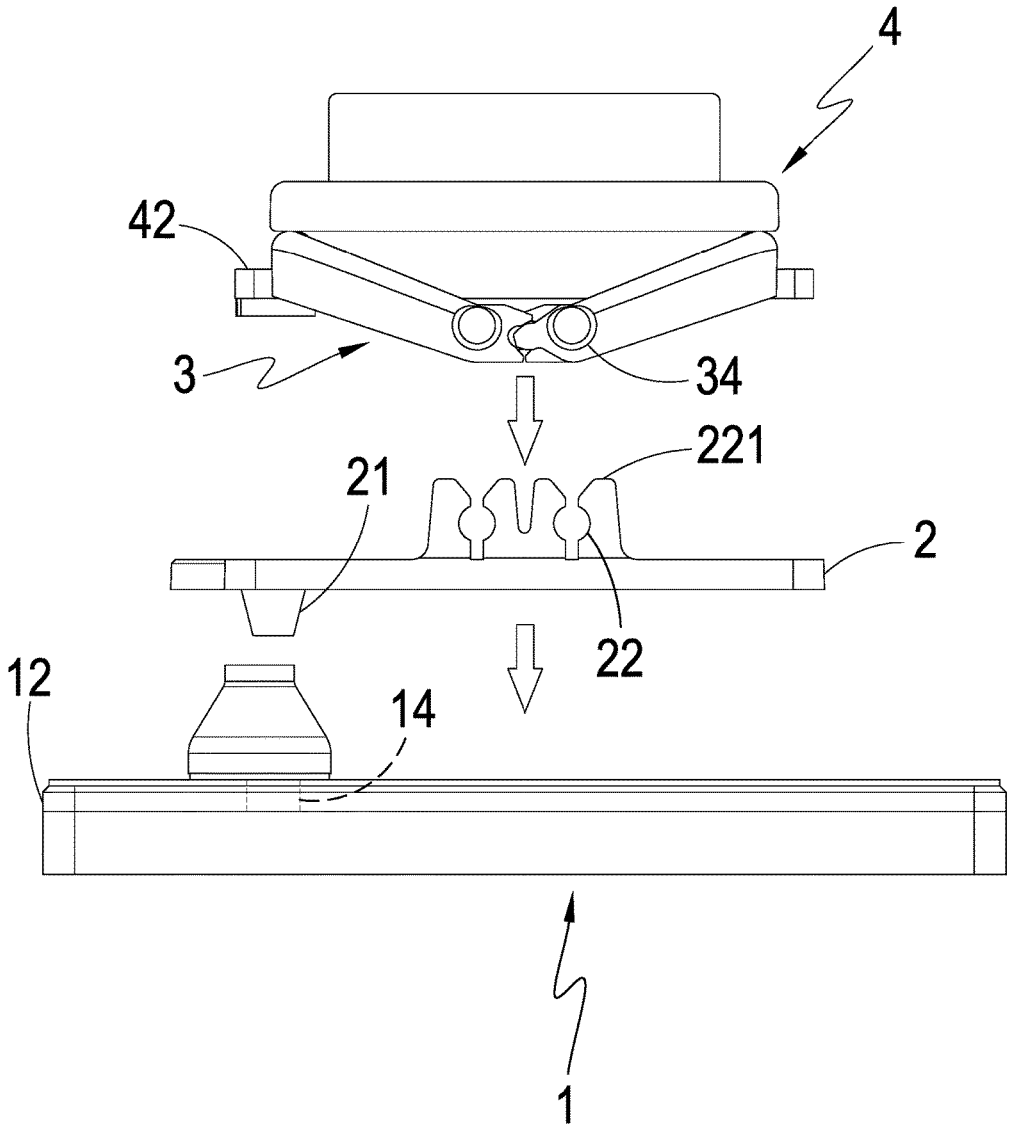
FIG. 6 is a schematic view illustrating assembly of the present invention.
Figure 7:
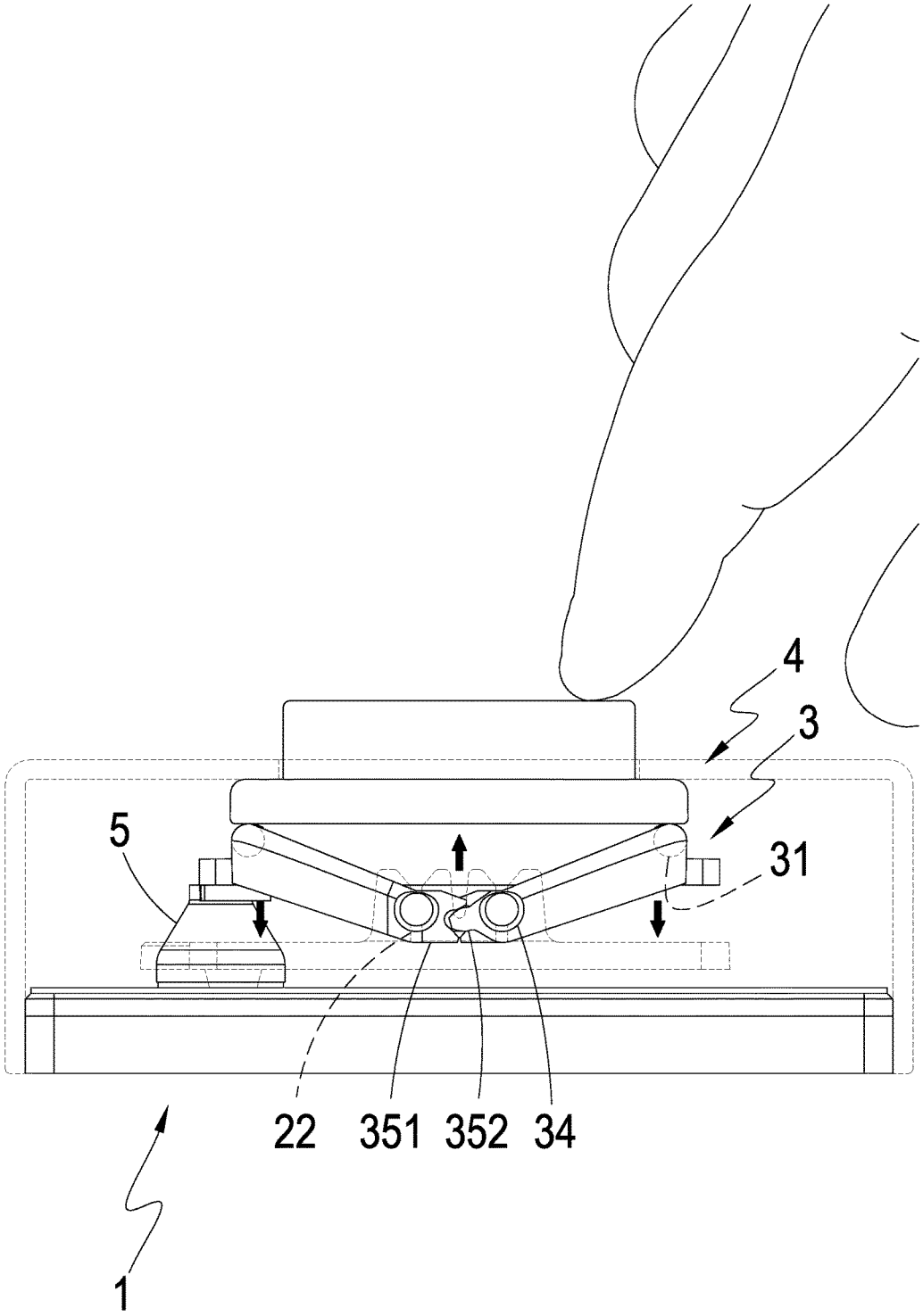
FIG. 7 is a schematic view illustrating operation of the present invention.
Figure 8:
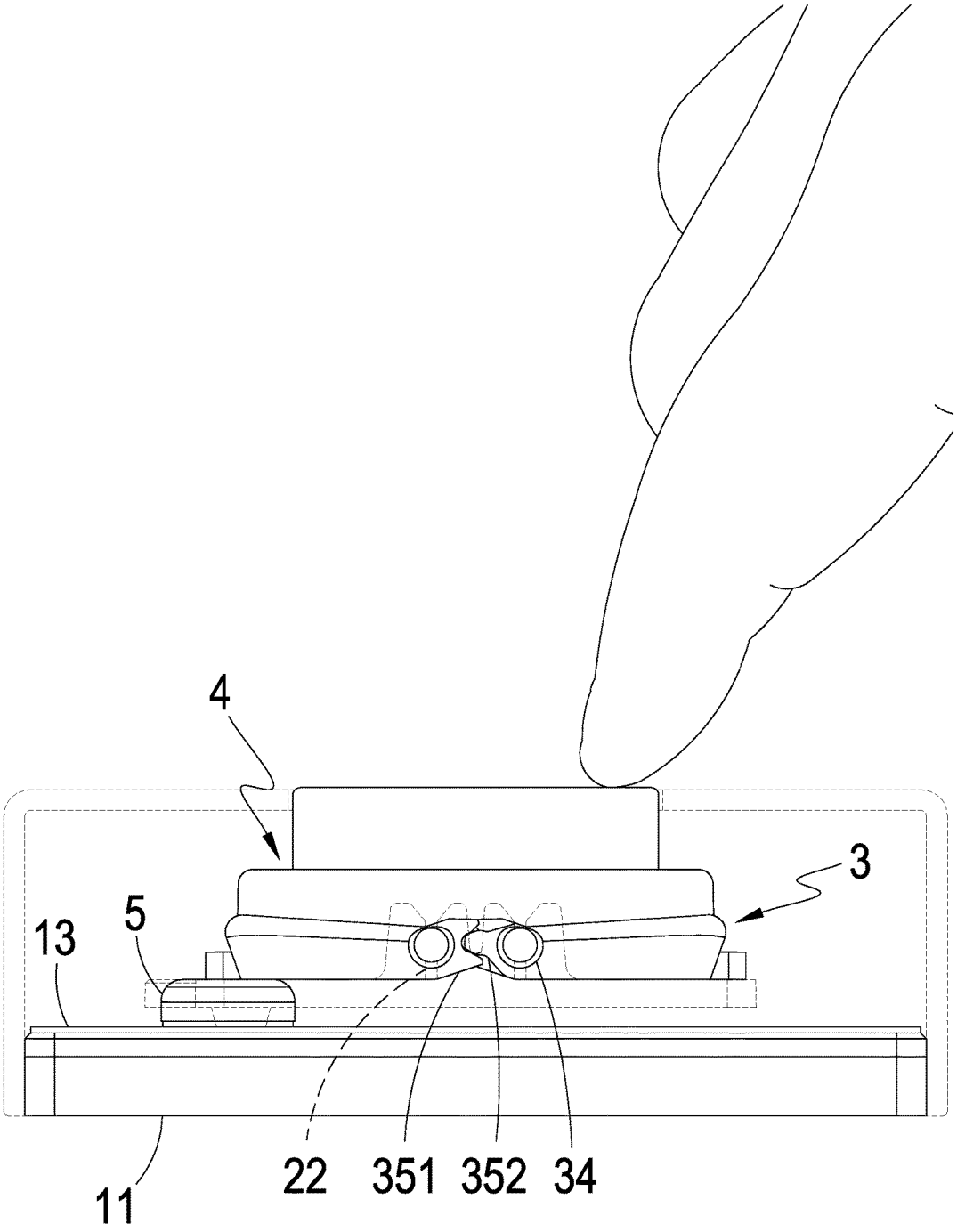
FIG. 8 is a schematic view illustrating operation of the present invention.
Figure 9:
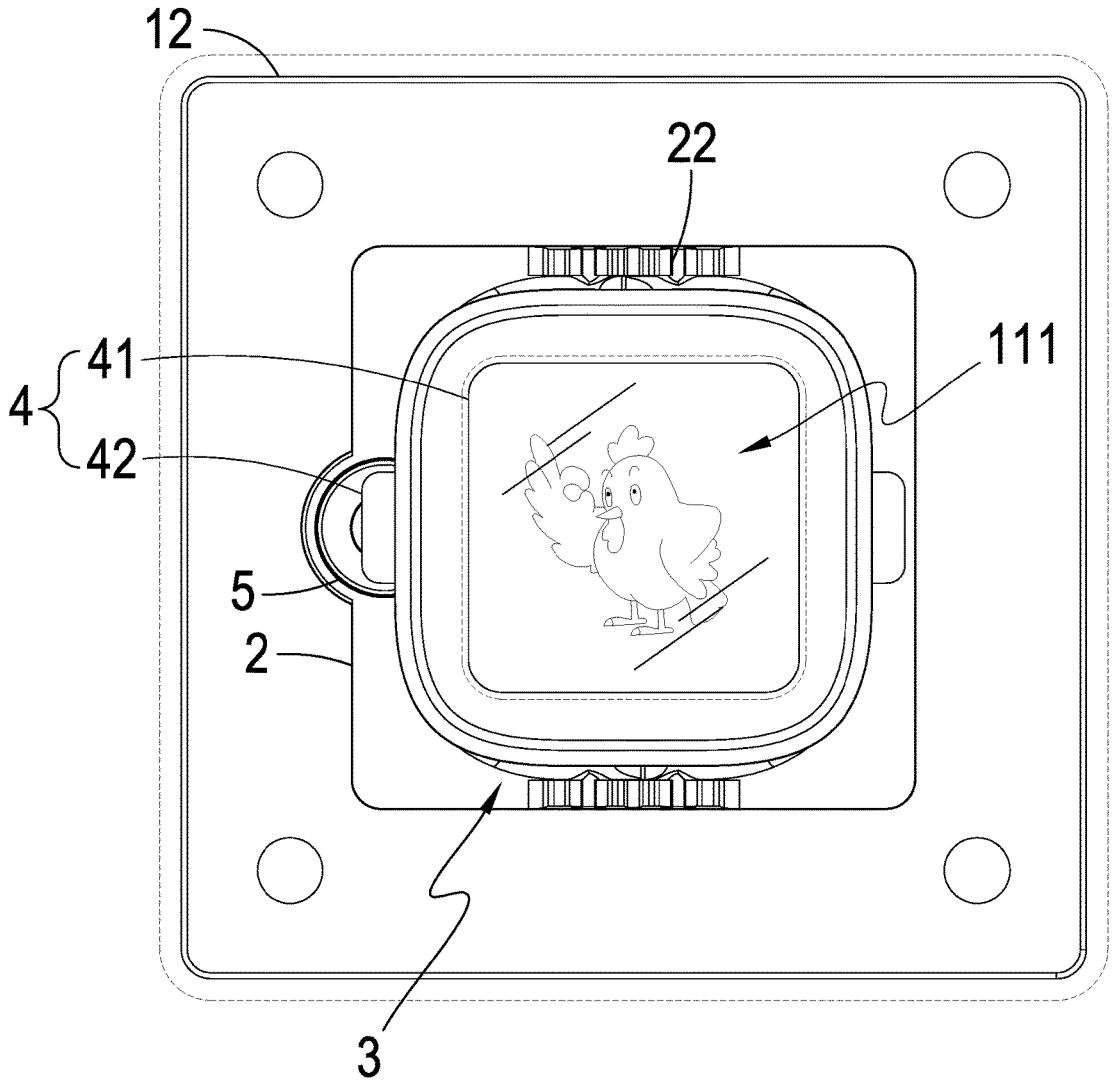
FIG. 9 is a schematic view illustrating a condition of use of the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1-5, the present invention comprises:

a display element 1 that displays at least one text/pattern section, wherein the display element 1 comprises a displaying screen 11, a button disposition bottom board 12 fixedly mounted on the displaying screen 11, and a membrane circuit 13 arranged on one side of the button disposition bottom board 12 that is opposite to the displaying screen 11 and electrically connected to the displaying screen 11 so that engagement of a hereinafter-described elastic element 5 therewith drives the displaying screen 11;

a plurality of mounting sections 14 formed in at least one side of the display element 1;

at least one hollowed bottom board 2 arranged above the display element 1 and having a hollowed portion that completely exposes the text/pattern section;

a plurality of joint sections 21 formed on one side of the hollowed bottom board 2 to correspondingly engage with and couple to the mounting sections 14;

a plurality of support frame members 3 rotatably mounted on an outer side of the hollowed bottom board 2, wherein each of the support frame members 3 comprises a connection rod section 31 that is rotatably mounted to one side of a hereinafter-described contacting section 42, a first support section 32 that is formed, in a curved manner, on one end of the connection rod section 31, and a second support section 33 formed, in a curved manner, on an opposite end of the connection rod section 31;

a plurality of first axle sections 34 respectively formed on sides of the first support section 32 and the second support section 33;

a plurality of position-constraining notches 22 formed on the hollowed bottom board 2 and receiving the first axle sections 34 to dispose therein, wherein each of the position-constraining notches 22 is provided with an elastic clamping section 221 to constrain the position of the first axle sections 34 therein;

at least one interconnection driving section 35 formed on ends of the support frame members 3 to couple and drive the support frame members 3 with each other in a synchronously rotatable manner, wherein the interconnection driving section 35 comprises a clamping section 351 formed on the first support section 32 and an engaging section 352 formed on the second support section 33 and engageable with and coupled to the clamping section 351 so that the support frame members 3 are movable in a manner of being capable of driving each other by means of the engagement between the clamping section 351 and the engaging section 352;

at least one button cap body 4 rotatably mounted to one side of the support frame members 3 that is opposite to the hollowed bottom board 2, wherein the button cap body 4 comprises a light-transmitting section 41 located exactly above the hollowed portion of the hollowed bottom board 2 for observation of the display element 1 by seeing therethrough and at least one contacting section 42 formed on an outer side of the light-transmitting section 41;

at least one first position-limiting section 43 formed on a sidewall of the button cap body 4 to receive and retain the connection rod section 31 therein;

at least one elastic element 5 mounted on the hollowed bottom board 2 for selectively contacting with the contacting section 42 to contact the membrane circuit 13 for driving the displaying screen 11; and at least one cover plate element 6 arranged above the display element 1, wherein the cover plate element 6 comprises at least one opening section 61 to allow the light-transmitting section 41 movably project therethrough.

As shown in FIGS. 1-9, in respect of outside appearance, the entirety of the outside appearance is similar to a regular keyboard, except the light-transmitting section 41 of the button cap body 4 is arranged to movably project out of the opening section 61 of the cover plate element 6, wherein the button cap body 4 is formed of the light-transmitting section 41 that is located at a central portion thereof and the contacting section 42 that is arranged at a peripheral side thereof and the support frame members 3 and the elastic element 5 that support a reciprocal vertical movement of the button cap body 4 to completely avoid of being exactly under the light-transmitting section 41 to thereby allow a user to see through the light-transmitting section 41 to the display element 1 located at the bottommost location to completely observe the text/pattern section 111 of the display element 1, wherein the elastic element 5 is arranged on the hollowed bottom board 2 and two ends of the support frame members 3 are respectively arranged in the first position-limiting sections 43 at the sides of the button cap body 4 and the position-constraining notches 22 of the hollowed bottom board 2. As such, the button can exhibit the contents of the displaying screen 11 through the light-transmitting section 41, and due to the displaying screen 11 being arranged at a bottommost position of the button structure, damages of the displaying screen 11 resulting from reciprocal movement of being pressed down or improper operation of the user. In addition, to achieve the purpose of lowering down cost of customization and individual button modularization, the button disposition bottom board 12 of the display element 1 is provided with a plurality of mounting sections 14 and the hollowed bottom board 2 is provided with a plurality of joint sections 21 respectively coupled to the mounting sections 14. In the instant embodiment, the joint sections 21 are made in the form of downward converging cones, while the mounting sections 14 are in the form of openings so that to couple the two, a minor force applied is sufficient to fit and fix the joint sections 21 to the mounting sections 14. Thus, it only needs to make the button disposition bottom board 12 in a customized form to suit clients' needs, and then, individual ones of the buttons can be mounted and installed one by one by means of the hollowed bottom board 2.

To simplify the support structure of the button cap body 4, the prior art scissors-like support is changed to the support frame members 3. The two support frame members 3 are of the same configuration of a U-shape formed of the connection rod section 31, the first support section 32, and the second support section 33, wherein the connection rod section 31 is rotatably mounted to the first position-limiting section 43 at one sidewall of the button cap body 4 and the first support section 32 and the second support section 33 are rotatably mounted in the position-constraining notches 22 through the first axle sections 34 so that the two support frame members 3 show a V-shaped configuration as being located between the button cap body 4 and the hollowed bottom board 2. Further, due to the arrangement of the elastic clamping section 221, a minor downward-pressing force applied would be sufficient to smoothly set and assemble the first axle sections 34 into the position-constraining notches 22. To allow the two support frame members 3 to support the reciprocal vertical movement of the button cap body 4, the first support section 32 of one of the two support frame members 3 is set in contact with the second support section 33 of another one of the two support frame members 3 with the clamping section 351 of the first support section 32 engaging with and coupled to the engaging section 352 of the second support section 33 so as to make the two support frame members 3 in an interconnected mutually-driving relationship.

Pressing down the button cap body 4 applies a downward force that is transmitted to the connection rod sections 31, such that one of the support frame members 3 rotates downward about a center defined by the first axle section 34, while the first axle sections 34 that is located on an opposite side of the clamping section 351 is caused to rotate upward due to leverage to thereby drive the engaging section 352 of another one of the two support frame members 3 to rotate upward. Similarly, due to the engaging section 352 rotating upward about a center defined by the first axle section 34 of another one of the support frame members 3, the connection rod section 31 that is opposite to the engaging section 352 is caused to rotate downward. As such, the operation of pressing down by the user may drive the button cap body 4 to smoothly descend to subsequently contact the elastic element 5 to trigger, through the membrane circuit 13, the displaying screen 11 to display a corresponding content, so that the user may see through the light-transmitting section 41 to the display element 1 at the bottommost position. In addition, since the two support frame members 3 are of an identical structure, the manufacturing cost and difficulty of assembly can be reduced.

Figure 10:
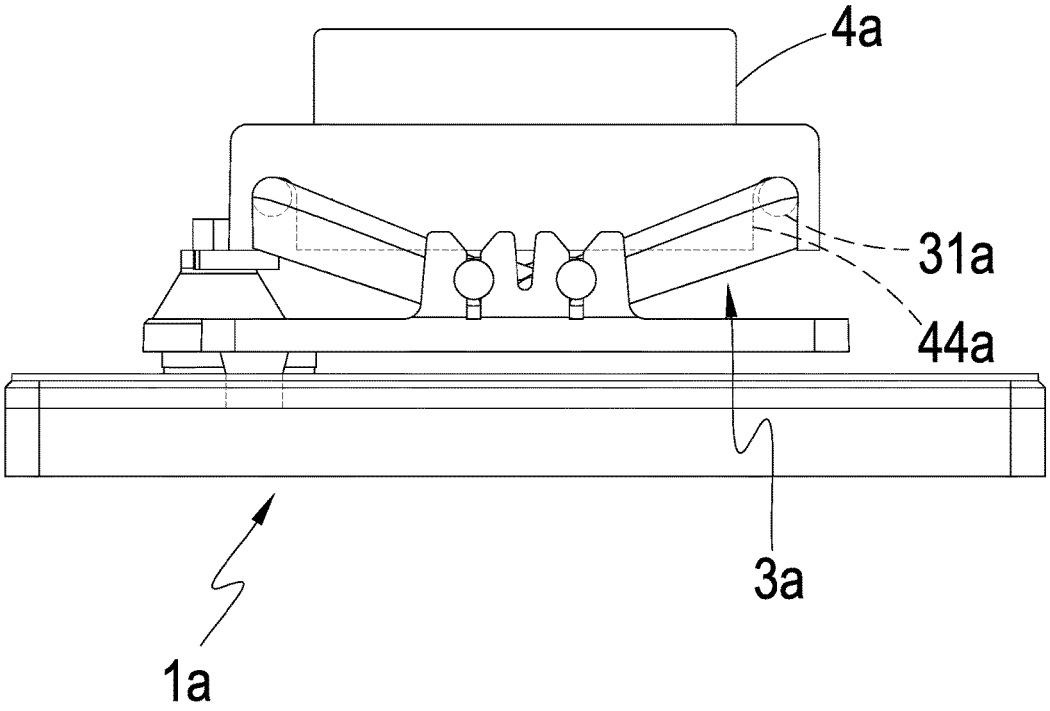
FIG. 10 is a schematic view illustrating another embodiment of the present invention.
Figure 11:
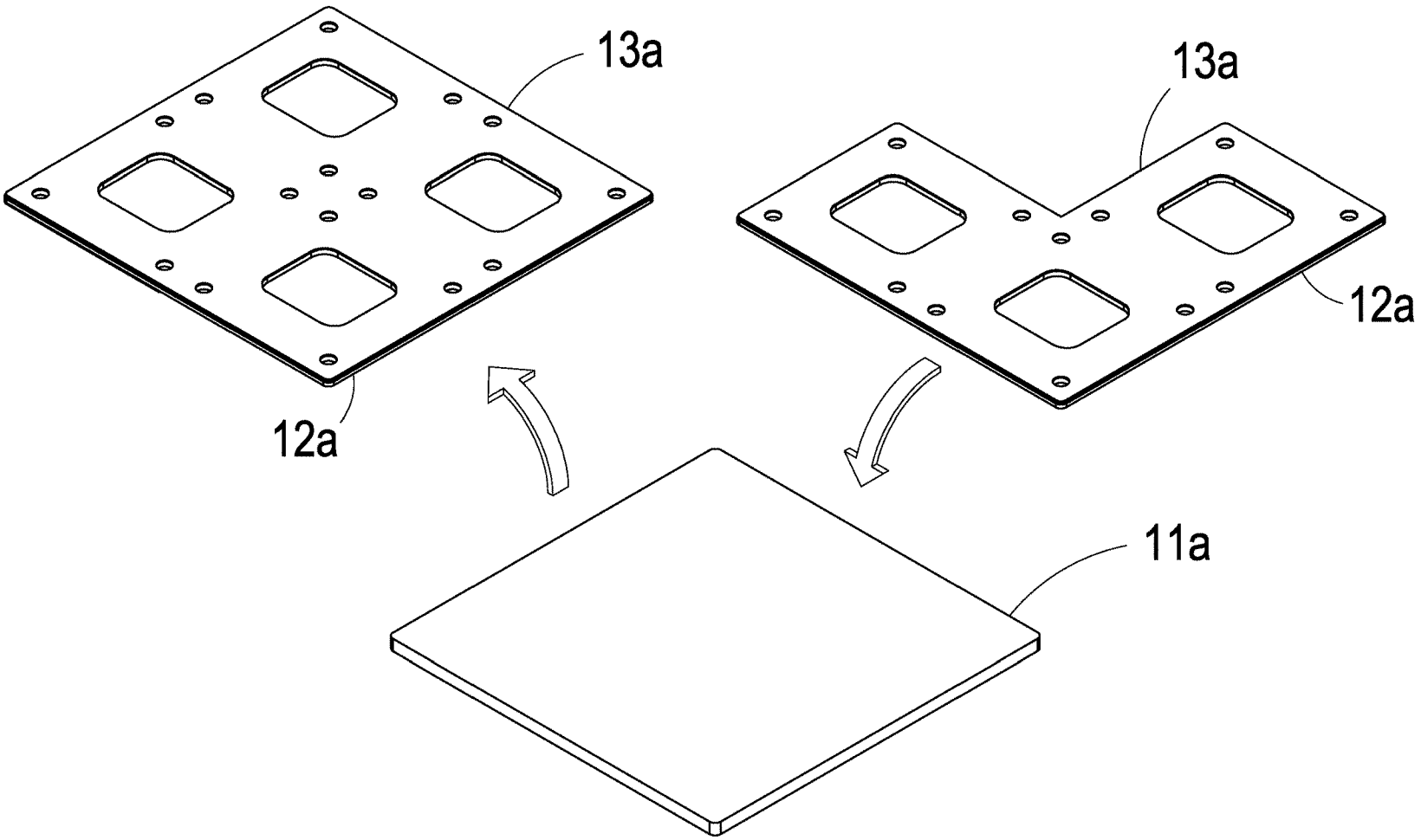
FIG. 11 is a schematic view illustrating assembly of another embodiment of the present invention.
Figure 12:
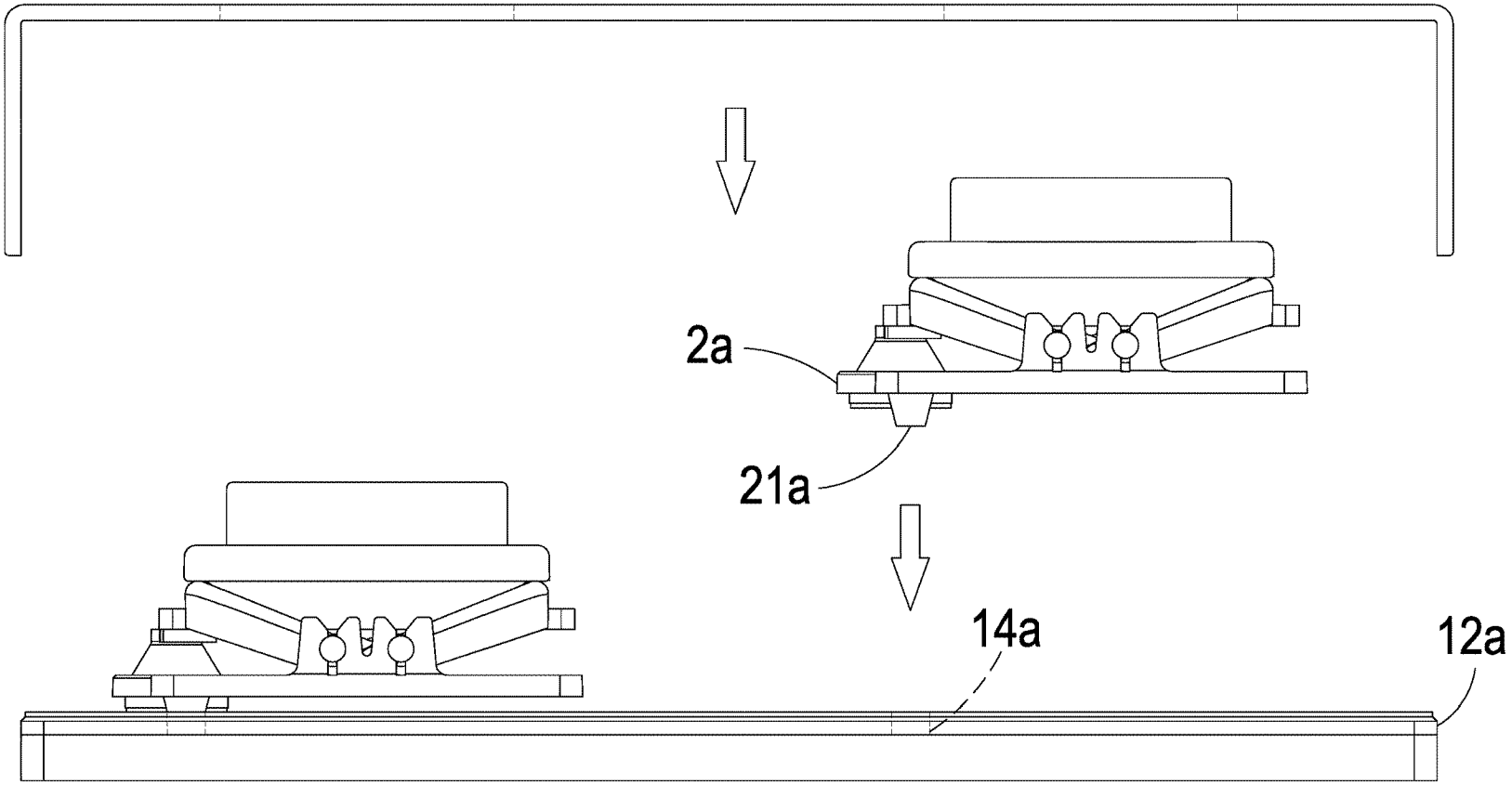
FIG. 12 is a schematic view illustrating assembly of another embodiment of the present invention.

As shown in FIGS. 10-12, in another embodiment, the first position-limiting section located on the sidewall of the button cap body 4*a* is removed and replaced by a second position-limiting section 44*a* arranged on the bottom so that the connection rod sections 31*a* of the support frame members 3*a* are directly mounted at a location that is outside the button cap body 4*a* to provide another feasible configuration, which similarly achieves the effect of individual piece modularization. Further, with the same displaying screen 11*a* being used, different button disposition bottom board 12*a* and membrane circuit 13*a* can be used in combination therewith to provide keyboard arrangements of different configurations. Further, fast modularized assembly may be similarly achieved through the joint sections 21*a* of the hollowed bottom board 2*a* and the mounting sections 14*a* of the display element 1*a* so as to allow for realization of customized production of keyboards by using the button disposition bottom board 12*a*.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A support frame structure of a see-through button, comprising:

a display element, which displays at least one text/pattern section;

a plurality of mounting sections formed on at least one side of the display element;

at least one hollowed bottom board arranged above the display element and having a hollowed portion that completely exposes the text/pattern section;

a plurality of joint sections formed on one side of the hollowed bottom board to correspondingly engage with and couple to the mounting sections;

a plurality of support frame members rotatably mounted on an outer side of the hollowed bottom board;

at least one interconnection driving section formed on ends of the support frame members to couple and drive the support frame members with each other in a synchronously rotatable manner;

at least one button cap body rotatably mounted to one side of the support frame members that is opposite to the hollowed bottom board, wherein the button cap body comprises a light-transmitting section located exactly above the hollowed portion of the hollowed bottom board for observation of the display element by seeing therethrough and at least one contacting section formed on an outer side of the light-transmitting section; and at least one elastic element mounted on the hollowed bottom board for selectively contacting with the contacting section to drive the display element;

wherein the contacting section that is formed on an outer side of the light-transmitting section is located outboard of the light-transmitting section and the elastic element that is mounted on the hollowed bottom board is arranged to correspond, in position, to the contacting section such that the contacting section and the elastic element that are contactable with each other are located outboard of the light-transmitting section to allow observation of the display element to be made directly through the light-transmitting section.

2. The support frame structure of the see-through button according to claim 1, wherein each of the support frame members comprises a connection rod section that is rotatably mounted on one side of the contacting section, a first support section that is formed, in a curved manner, on one end of the connection rod section, and a second support section formed, in a curved manner, on an opposite end of the connection rod section.

3. The support frame structure of the see-through button according to claim 2, wherein the interconnection driving section comprises a clamping section formed on the first support section and an engaging section formed on the second support section and engageable with and coupled to the clamping section.

4. The support frame structure of the see-through button according to claim 3, wherein the support frame members are connected to each other, in a manner of mutually driving each other, by means of the clamping section and the engaging section.

5. The support frame structure of the see-through button according to claim 2, wherein sides of the first support section and the second support section are respectively provided with first axle sections, and the hollowed bottom board is provided with a plurality of position-constraining notches for receiving and holding the first axle sections.

6. The support frame structure of the see-through button according to claim 5, wherein each of the position-constraining notches is provided with an elastic clamping section for positioning of the first axle sections.

7. The support frame structure of the see-through button according to claim 2, wherein the button cap body comprises at least one first position-limiting section formed on a sidewall thereof for retaining the connection rod section.

8. The support frame structure of the see-through button according to claim 1, wherein the display element comprises a displaying screen, a button disposition bottom board fixedly mounted on the displaying screen and comprising the mounting sections, and a membrane circuit arranged on one side of the button disposition bottom board that is opposite to the displaying screen and electrically connected to the displaying screen so that engagement of the elastic element therewith drives the displaying screen.

9. The support frame structure of the see-through button according to claim 2, wherein at least one second position-limiting section is formed at a bottom side of the button cap body for supporting and retaining the connection rod section.

10. The support frame structure of the see-through button according to claim 1 further comprising at least one cover plate element arranged above the display element, wherein the cover plate element comprises at least one opening section to allow the light-transmitting section movably project therethrough.

* * * * *